United States Patent [19]

Koncelik et al.

[11] 4,366,999

[45] Jan. 4, 1983

[54] FOLD-DOWN DESK

[76] Inventors: Joseph A. Koncelik, 1638 Dolliver Dr., Worthington, Ohio 43085; David B. Chaney, 1944 Wolverhampton, Powell, Ohio 43065

[21] Appl. No.: 188,023

[22] Filed: Sep. 17, 1980

[51] Int. Cl.[3] ..... A47B 83/00; A47B 27/00

[52] U.S. Cl. ..... 312/237; 312/231; 312/223; 312/233; 108/38; 248/240.4

[58] Field of Search ..... 312/237, 231, 233, 230, 312/196, 223, 320, 315; 108/38; 248/240.1, 240.4, 215, 201, DIG. 5

[56] References Cited

U.S. PATENT DOCUMENTS

| | | | |
|---|---|---|---|
| 211,656 | 1/1879 | Graves et al. | 108/38 |
| 837,000 | 11/1906 | Sibley | 312/315 |
| 893,694 | 7/1908 | Allenson | 108/38 |
| 1,416,555 | 5/1922 | Hall | 312/233 |
| 1,428,957 | 9/1922 | Hall | 108/38 |
| 1,576,034 | 3/1926 | Butt | 248/240.4 |
| 1,969,306 | 8/1934 | Hunter | 312/233 |
| 2,084,197 | 6/1937 | Grosser | 312/233 |
| 2,488,326 | 11/1949 | Pratt | 248/DIG. 5 |
| 2,615,541 | 10/1952 | Whitesel | 312/315 |
| 2,653,851 | 9/1953 | Davidson | 312/320 |
| 2,738,942 | 3/1956 | Gantner | 248/DIG. 5 |
| 2,792,053 | 5/1957 | Kursman | 248/240.1 |
| 3,048,461 | 8/1962 | Peterson | 312/196 |
| 3,193,341 | 7/1965 | Preston | 312/231 |
| 3,684,344 | 8/1972 | Gilinger | 312/223 |
| 4,184,724 | 1/1980 | Katz et al. | 312/320 |

*Primary Examiner*—Victor N. Sakran

*Attorney, Agent, or Firm*—Cushman, Darby & Cushman

[57] ABSTRACT

A fold-down desk is provided especially adapted for use in nursing homes. The desk is composed of a casing and a writing surface, with the writing surface pivotally mounted to the casing. Special hangers mount the casing to a wall panel so that the writing surface is movable from a first position, in which it is vertical and abuts the casing, to a second position at which it is stopped with respect to the casing and is substantially vertical. The writing surface and casing are interconnected so that as the writing surface is moved away from the casing about the pivot structure, the movement of the writing surface is slow and gradual until it is positively stopped at the end of its path of travel. All portions of the writing surface and casing have rounded edges, the writing surface is flat with a raised edge around the circumference thereof, and elongated recesses are provided along the periphery of the cases.

4 Claims, 6 Drawing Figures

Fig. 1
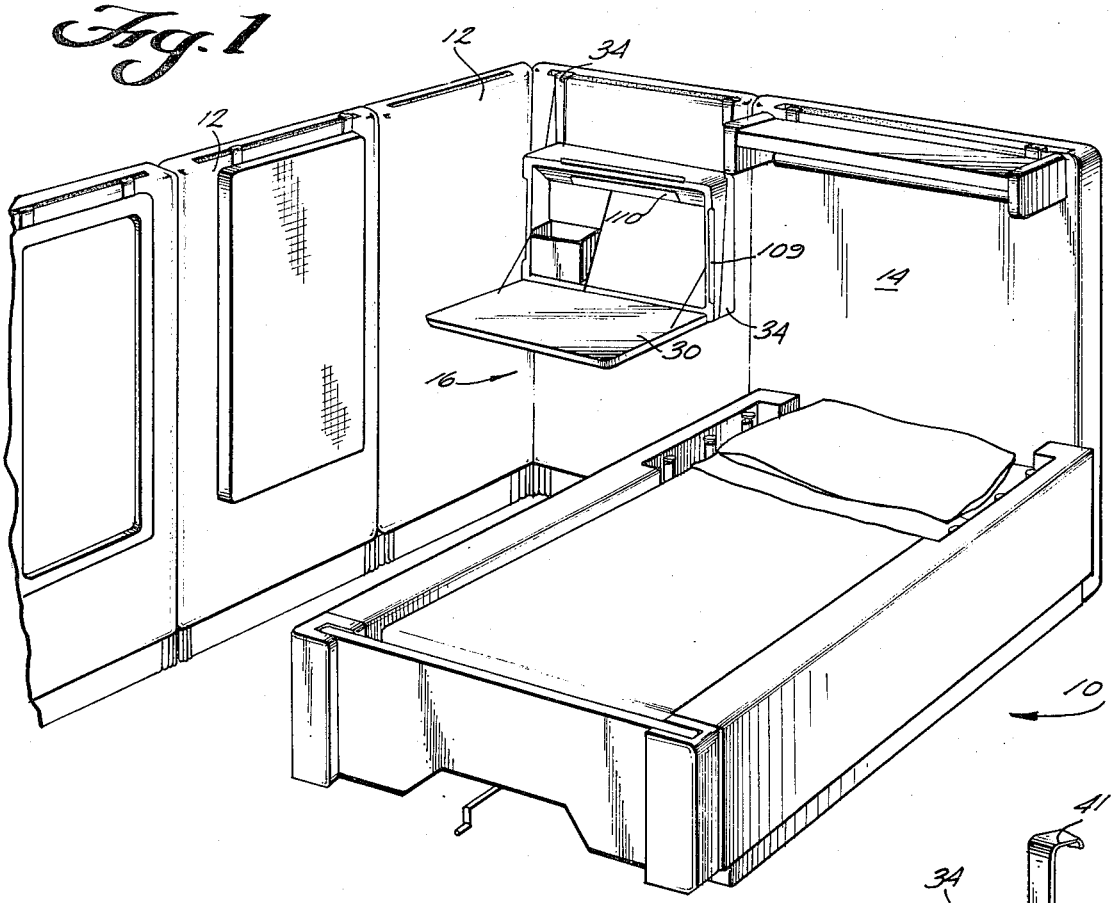
Fig. 2
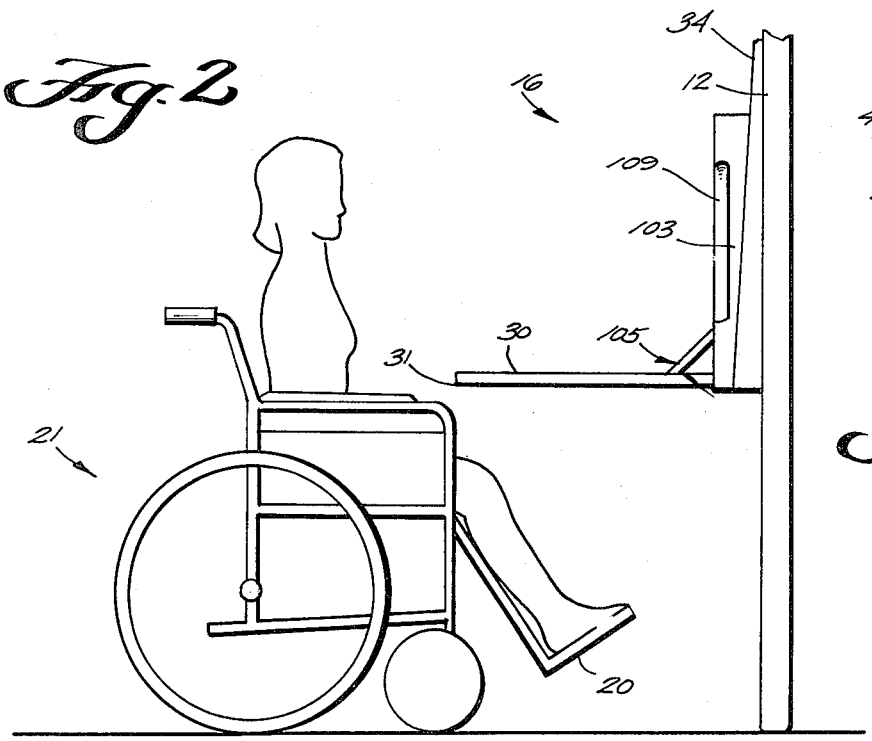
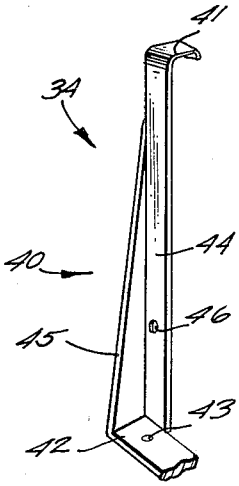
Fig. 6

FOLD-DOWN DESK

BACKGROUND AND SUMMARY OF THE INVENTION

The invention relates to an article of furniture specifically adapted to be used as a desk in a nursing home, or other geriatric, environment. The nursing home environment presents many challenging problems to the appropriate design of furnishings making up the personal space in room setting where aged people spend the majority of their time. The desk assembly according to the present invention is specifically constructed with such design criteria in mind.

The fold-down desk assembly according to the present invention is preferably utilized in a personal space defining system such as disclosed in copending application Ser. No. 136,095, filed Mar. 31, 1980 by Joseph A. Koncelik, now U.S. Pat. No. 4,332,042 (the disclosure of which is hereby incorporated by reference herein). Such a system provides room divisions for a nursing home and furnishings integrated therewith for providing safety, comfort, control, and sense of personal ownership for aging people to be occupying the nursing home. The desk assembly according to the present invention is imminently suited for such a system since it is capable of being folded out of the way, may be readily used by non-ambulatory individuals, has built-in safety features, and can be moved from the operative to non-operative positions and vice versa by even aged individuals having severe arthritis.

The desk assembly according to the present invention is preferably mounted on a wall, particularly a wall panel. The assembly includes a casing, a writing surface, means for pivotally mounting the writing surface to the casing, and means for interconnecting the writing surface and the casing so that as the writing surface is moved away from the casing about the pivot means the movement of the writing surface is slow and gradual until it is positively stopped at a predetermined position. Additionally means are provided for mounting the casing to a wall panel so that the writing surface is movable from a first position wherein it is substantially vertical and abuts the casing, to a second position wherein it is stopped with respect to the casing in a substantially horizontal position. The desk assembly is mounted so that it can easily accommodate a wheelchair user. The depth of the surface is sufficient to allow penetration of a wheelchair beneath the surface, and it is at a height for ready use by a person in a wheelchair.

The writing surface comprises a flat body portion with a raised edge around substantially the entire circumference thereof. The raised edge prevents roll off of objects or liquids, which is especially important considering the limited dexterity of potential users. Additionally all corners of the writing surface and casing are rounded to maximize safety. The casing comprises means defining large elongated recesses around the periphery of the casing so that when the writing surface is substantially vertical and abuts the casing it may be readily grasped and pivoted downwardly by an individual inserting a portion of their hand between the writing surface and the casing at a recess. This is especially important for users having arthritic conditions.

Special hangers are provided for mounting the desk on a wall panel. A preferred hanger comprises a pair of arms each having a hook at a first end thereof for hooking onto a top portion of the wall panel. A flattened portion may be provided at the second end thereof opposite the first end, the second portion operatively attached to the casing. Each arm may comprise first and second perpendicular faces, the first face engaging the back of the casing, and the second face engaging a side surface of the casing.

It is the primary object of the present invention to provide a fold-down desk assembly particularly adapted for mounting on a wall panel, and for use in a geriatric environment. This and other objects of the invention will become clear from an inspection of the detailed description of the invention, and from the appended claims.

BRIEF DESCRIPTION OF THE DRAWINGS

FIG. 1 is a perspective view illustrating a desk assembly according to the present invention in use in a system providing room divisions and furnishings for a nursing home;

FIG. 2 is a side view of an exemplary desk according to the present invention shown in position for use by a person in a wheelchair;

FIG. 6 is a perspective view of an arm of an exemplary hanger utilizable for supporting the desk as illustrated in FIGS. 1 and 2.

DETAILED DESCRIPTION OF THE DRAWINGS

Figure 3:
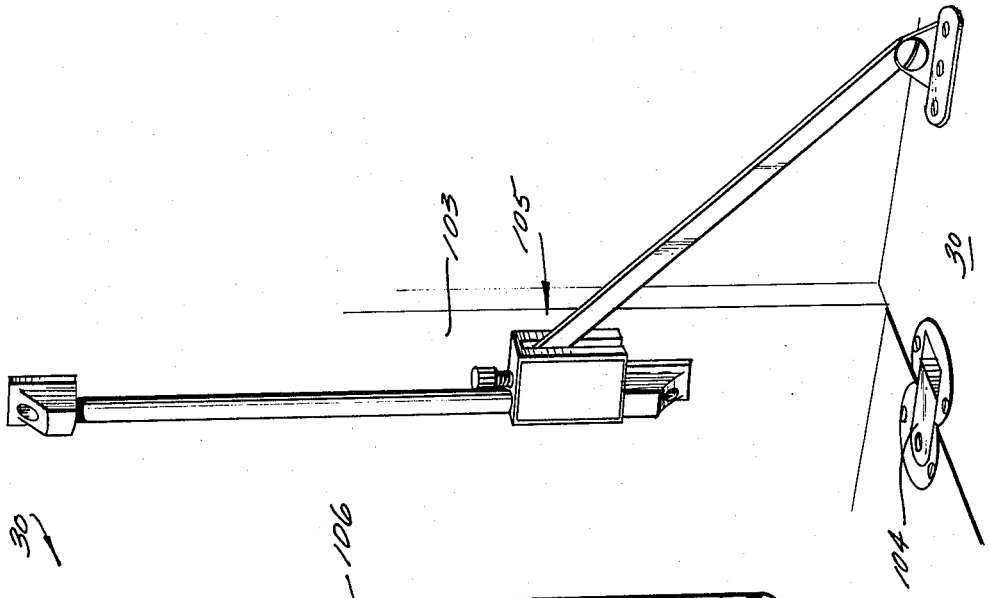
FIG. 3 is a perspective view of an exemplary flap brake utilizable with the desk illustrated in FIGS. 1 and 2.

An exemplary interior space division for a nursing home utilizing a fold-down desk assembly 16 according to the present invention is illustrated in FIG. 1. A bed assembly 10, plurality of wall panels 12, 14 and a plurality of other miscellaneous clothing and article supporting and enclosing structures are provided.

The wall panels 12 with which the desk 16 is adapted to be used preferably are comparable to conventional upholstered panels for dividing work areas in office space. Exemplary such panels are sold by J. G. Furniture, a division of Burlington Industries, of Quakertown, Pa., under the name "UPS". Conventional panel joining hardware is utilized to attach the panels 12, 14 together.

As illustrated in the drawings, the fold-down desk 16 includes a writing surface 30 and a casing 103. Special hangers 34 mount the casing 103 so that the writing surface is at the position illustrated in FIG. 2, for ready use by a person in a wheelchair, being spaced off the ground a distance sufficient for penetration by the toeboard 20 of a wheelchair 21 with the user's torso adjacent the front edge 31 of the writing surface 30, and spaced from the wall panel 12 a distance also sufficient to accommodate such penetration. For instance the depth of the writing surface 30 may be about 24 inches, and it may be located 31 inches off the ground in the position illustrated in FIG. 2.

The fold-down desk assembly 16 further comprises means, such as hinges 104 (see FIG. 3) for pivotally mounting the writing surface 30 and casing 103 together. Means, such as flap brakes 105, are also provided for interconnecting the writing surface 30 and casing 103 so that as the writing surface is moved away from the casing about the pivot means 104 the movement of the writing surface 30 is slow and gradual until it is positively stopped at a predetermined (horizontal) position, as illustrated in FIG. 2. Such slow and gradual movement is for safety reasons, and minimizes damage to the desk components. Any conventional type of flap brakes may be utilized, such as braking lid stay type K-54 manufactured by Wood Technology, Inc. of Midland Park, N.J., or Hafele flap brakes sold under the trademark "FALL-EX". A Wood Technology, Inc. braking lid stay type K-54 is illustrated in FIG. 3.

The hangers 34 mount the casing 103 to a wall, preferably a wall panel 12 so that the writing surface 30 is movable from a first position, wherein it is substantially vertical and abuts the casing 103 (it may be held in this position with a latch if desired), to a second, operative position wherein it is stopped with respect to the casing 103 and is substantially horizontal. The second position is illustrated in FIGS. 1 and 2.

The hanger 34 preferably comprises a pair of arms, one of the arms 40 being illustrated in FIG. 6. Each arm 40 includes a hook 41 at a first end thereof for hooking onto a top portion of the panel 12. Each of the arms 40 may comprise first and second faces 44, 45 respectively. The first face 44 engages a surface of the casing opposite the writing surface 30 (i.e. the back of the casing), while the second face 45 engages a side surface of the casing 103. Either or both of the faces 44, 45 may also be attached to the casing, as by screws passing through hole 46 in face 44 illustrated in FIG. 6. A flattened portion 42 may or may not be provided at a second end of arm 40, opposite the first end 41, for operative attachment to the casing. For instance screws may be passed through holes 43 in flattened portion 42 into the bottom of the casing 103. The arms 40 may be entirely separate from each other, or the hanger 34 may be formed by joining the surfaces 42 (where provided) of the two arms 40. Additional hooks may also be provided if required.

Figure 5:
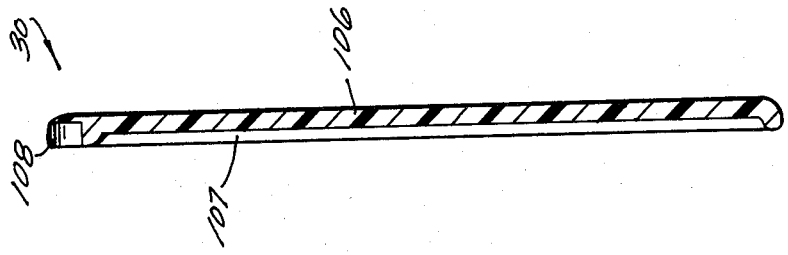
FIG. 5 is a cross-sectional view taken along lines 5—5 of FIG. 4.
Figure 4:
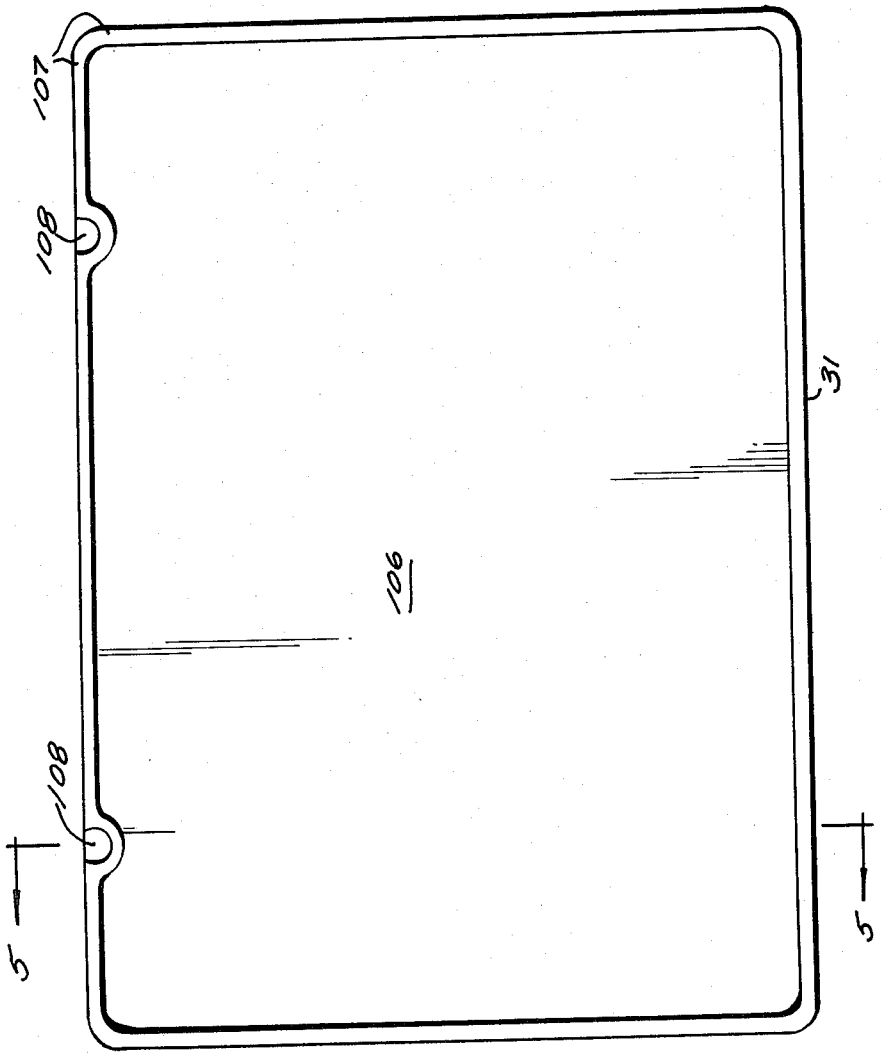
FIG. 4 is a top plan view of the writing surface of the fold-down desk illustrated in FIGS. 1 and 2.

The writing surface, which preferably is made of plastic, comprises a flat body 106 (see FIGS. 4 and 5 in particular) with a raised edge 107 around substantially the entire circumference thereof. Edge 107 prevents roll-off of objects and liquids. Flattened portions 108 are provided along one edge of the tray 30 for receipt of the hinges 104.

The casing 103 includes means defining an elongated recess 109 (see FIGS. 1 and 2) along at least one side of the periphery of casing 103. The recess 109 is defined so that when the writing surface 30 is substantially vertical and abuts the casing 103 the writing surface may be readily pivoted downwardly by an individual merely putting their palm, or other portion, of their hand between the writing surface 30 and the casing 103 at the recess 109. This is especially important for arthritic users.

If desired, a light source 110 may be disposed within the casing 103 and conventional means (such as switch response to the position of surface 30) may be provided for automatically actuating the light source to turn it on when the writing surface is moved to the substantially horizontal position thereof.

While the invention has been herein shown and described with particular reference to a geriatric environment, it will be apparent to those of ordinary skill in the art that it may be used in other environments as well. A college dormitory or marine vessel are typical examples of other environments in which the invention would be useful.

Further, while the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the equivalent claims so as to encompass all assemblies and devices.

What is claimed is:

1. A desk assembly for removeable mounting on, and in combination with, a wall panel, said assembly comprising: a casing; a plastic writing surface comprising a flat body portion with a raised edge around substantially the entire circumference thereof; means for pivotally mounting said writing surface to said casing; means for interconnecting said writing surface and said casing so that as said writing surface is moved away from said casing about said pivot means the movement of said writing surface is slow and gradual until it is positively stopped at a predetermined position; and means for mounting said casing to said wall panel so that said writing surface is moveable from a first position wherein it is substantially vertical and abuts said casing, to a second position wherein it is stopped with respect to said casing and is substantially horizontal; said wall panel and said casing mounting means being dimensioned so that said writing surface when in said second position is spaced from the ground a distance convenient for use by a person in a wheelchair, and wherein an edge of said writing surface opposite said pivotally mounting means is spaced from said wall panel a distance so that the writing surface is convenient for use by a person in a wheelchair, wherein said casing comprises means defining large elongated recesses around the entire periphery of said casing so that when said writing surface is substantially vertical and abuts said casing said writing surface may be readily grasped and pivoted downwardly by an individual inserting a portion of their hand between the writing surface and said casing at said recess.

2. An assembly as recited in claim 1 further comprising a light source disposed within said casing; and means for automatically actuating said light source to turn it on when said writing surface is moved to the substantially horizontal position thereof.

3. An assembly as recited in claim 1 wherein said wall comprises a wall panel and wherein said means for mounting said casing to a wall panel comprises a pair of arms each having a hook at a first end thereof for hooking onto a top portion of a wall panel, and operatively attached to said casing.

4. An assembly as recited in claim 3 wherein each of said arms comprises first and second integral perpendicular faces, said first face engaging a surface of said casing opposite said writing surface, and said second face engaging a side surface of said casing.

* * * * *